US006050124A

United States Patent [19]

Shiroza

[11] Patent Number: 6,050,124

[45] Date of Patent: Apr. 18, 2000

[54] TRANSFER FEEDER HAVING TWO DIFFERENT DRIVE MODES AND METHOD OF ITS OPERATION

[75] Inventor: Kazuhiko Shiroza, Ishikawa, Japan

[73] Assignee: Komatsu Ltd., Tokyo, Japan

[21] Appl. No.: 09/232,531

[22] Filed: Jan. 18, 1999

[30] Foreign Application Priority Data

Feb. 4, 1998 [JP] Japan ..... P10-023050
Feb. 4, 1998 [JP] Japan ..... P10-023068

[51] Int. Cl.[7] ..... B21D 43/05

[52] U.S. Cl. ..... 72/405.16; 72/405.1; 72/405.13; 198/621.1; 198/621.3; 100/207

[58] Field of Search ..... 72/405.16, 405.13, 72/405.12, 405.11, 405.1, 405.09, 405.01; 198/621.1, 621.3; 414/751; 100/207

[56] References Cited

U.S. PATENT DOCUMENTS

| | | | |
|---|---|---|---|
| 3,746,184 | 7/1973 | Wallis | 72/405.13 |
| 4,540,087 | 9/1985 | Mizumoto | 72/405.16 |
| 4,785,657 | 11/1988 | Votava | 72/405.14 |
| 5,081,860 | 1/1992 | Rante | 72/405.13 |

FOREIGN PATENT DOCUMENTS

| | | | |
|---|---|---|---|
| 62-26848 | 6/1987 | Japan . | |
| 63-194831 | 8/1988 | Japan | 72/405.01 |
| 6-106271 | 4/1994 | Japan . | |
| 7-47497 | 2/1995 | Japan . | |

*Primary Examiner*—Daniel C. Crane
*Attorney, Agent, or Firm*—Frishauf, Holtz, Goodman, Langer & Chick, P.C.

[57] ABSTRACT

A transfer feeder (2) that is operable in a mechanical synchronism with a press machine (1) to prevent an interference of a movable part in the press machine (1) and a movable part in the transfer feeder (2) is disclosed that comprises a feed drive means (10) having a feed lever (10*a*) adapted to be swung for moving a group of feed carriers (6) or a transfer bar that carries workpieces in a workpiece feed direction. The feed drive means (10) is further provided with a cam drive means (12) comprising a feed cam (12*b*) adapted to be rotated in a mechanical synchronism with an operation of the press machine (1) by power taken out of the press machine with a power takeout means (14). The feed cam (12*b*) and the feed lever (10*a*) are associated with a switching means (19) for coupling them together and decoupling them each other. A servo drive means (13) comprising a servo controllable feed motor (21) is also provided to swing the feed lever (10*a*). A clutch (24) is disposed between the feed motor (21) and the feed lever (10*a*) for coupling them together and decoupling them each other. In the transfer feeder (2) so constructed, the switching means (19) and the clutch (24) are actuated to render one of cam drive means (12) and the servo drive means (13) selectively operable to swing the feed lever (10*a*).

13 Claims, 8 Drawing Sheets

1
1a
1b
1c
1c
1c

TRANSFER FEEDER HAVING TWO DIFFERENT DRIVE MODES AND METHOD OF ITS OPERATION

TECHNICAL FIELD

The present invention relates to a transfer feeder that is adapted to be selectively operable in each one and both of a cam drive mode and a servo drive mode, and a method of operating or running such a transfer feeder.

BACKGROUND ART

A transfer press in which a plurality of pressing stations are provided in series in a press machine to permit a workpiece to be sequentially pressed in these stations, commonly includes a transfer feeder that is adapted to be driven to convey and transfer the workpiece sequentially in the successive press stations.

Such a transfer feeder typically includes a pair of transfer bars arranged parallel to each other and extending in a workpiece feed direction, and a drive means for driving the transfer bars two- or three-dimensionally to transfer the workpiece or to move it in a desired pattern of movement with the transfer bars driven. The known drive means for driving the transfer bars may be either of cam drive type or of servo drive type and can only be operated in either a cam drive mode or a servo drive mode.

For example, Japanese Examined Patent Application No. Sho 62-26848 discloses a transfer feeder that adopts a drive means of cam drive type in which a cam rotated by a power taken out of a press machine causes a lever to oscillate, thereby to cause the transfer bars to be driven, three-dimensionally, in a feed, a lifting and a clamping direction, respectively, with a feed, a lifting and a clamping lever that are interlocked with the transfer bars. The system described has a construction in which the press machine and the transfer feeder are mechanically synchronized in operation, which provides an advantage that an emergency or unexpected shutdown of the press machine if required or if it happens may not cause a movable part of the press machine and a movable part of the transfer feeder to interfere with each other.

In a transfer feeder of cam drive type, however, a transfer parameter such as a lifting stroke or a clamping stroke must be determined by a profile of a cam. Then, if such a stroke needs to be altered, the cam must be replaced. If a plurality of the feed cams need to be used as described in the publication referred to above, those cams must be replaced. Replacing a cam is a time-consuming task in a transfer press system and reduces its productivity. Also, inconveniently enough the requirement to replace a plurality of cams makes the drive system complicated and increases its cost of manufacture.

On the other hand, Japanese Unexamined Patent Publication No. Hei 6-106271 and No. Hei 7-47497 disclose a transfer feeder of servo drive type in which the drive means comprises as its drive source servo motors to drive the transfer bars two- or three-dimensionally. The transfer feeder of servo drive type advantageously permits its feed stroke, lifting stroke and clamping stroke to be readily altered simply with the servo motors controlled, thus of advantage does not require a particular setup operation in order to meet a change in workpiece sizes and shapes as required.

The construction in which the press machine and the transfer feeder are electrically synchronized in operation, however, entails the possibility that development of any abnormality in a path of transmission of signals between them may well injure their synchronization, thus causing a movable part in one of them and a movable part in the other to interfere with each other.

To prevent an interference between a movable part in a press machine and a movable part in a transfer feeder, a measure is described in Japanese Unexamined Patent Publication No. Hei 6-106271, in which when a press machine comes to be stopped by a power failure, the kinetic energy of its upper die descending is converted to an electric energy which is then used to move the die to a safety site where it may not interfere with any movable part in the transfer feeder.

In the arrangement described in Japanese Unexamined Patent Publication No. Hei 7-47497, an angle of rotation that needs to be effected to cause the transfer feeder to halt after the press machine is stopped is preliminarily stored in a memory as a data which is used on an actual occasion as a control data to operate the transfer feeder to prevent an interference between a movable part in the press machine and an movable part in the transfer feeder.

The measure and arrangement adopted in these latter publications are, however, only operative responsive to a trouble indicative signal that can be derived from a path of communication between a press machine and a transfer feeder, and are not effectively applicable to a situation in which an abnormality takes place in a control means for the transfer feeder, causing it to run away. Of inconvenience, then, an interference of the type described cannot, in effect be prevented.

SUMMARY OF THE INVENTION

Made to remedy these problems met in the prior art, it is an object of the present invention to provide a transfer feeder that can be selectively operated, and a method of operating a transfer feeder that makes the transfer feeder operable, in each one or both of a cam drive mode and a servo drive mode. A further object of the present invention to provide a transfer feeder and a method of operating a transfer feeder whereby should an abnormality happen in a control means or a control signal path a movable part In a press machine and a movable part in the transfer feeder are prevented from interfering with each other.

As embodied in a first form thereof, the present invention provide a transfer feeder having a pair of feed carrier groups, each group arranged parallel to the other and comprising a plurality of feed carriers coupled together in a workpiece feed direction, a cross bar extending across a pair of such feed carriers opposed each other, and a feed and a lifting drive means for moving the feed carrier groups two-dimensionally, the transfer feeder transferring workpieces carried by the cross bar into each of successive work stations in a press machine wherein: the said feed drive means comprises: a feed lever adapted to be swung for moving the said feed carrier groups in a workpiece feed direction; a cam drive means comprising a feed cam adapted to be rotated in a mechanical synchronism with an operation of the said press machine by power taken out of the said press machine; a switching means associated with the said feed cam and the said feed lever for coupling them together and decoupling them from each other; a servo drive means comprising a servo controllable feed motor for swinging the said feed lever, and a clutch means disposed between said feed motor and said feed lever for coupling them together and decoupling them from each other, the said switching means and the said clutch means being adapted to be actuated to render one of the said cam drive mean and the said servo drive means selectively operable to swing the said feed lever.

As embodied in a second form thereof, the present invention provides a transfer feeder having a pair of transfer bars arranged parallel to each other in a workpiece transfer direction, a finger arranged on each of said transfer bars, and a feed, a lifting and a clamping drive means for moving said transfer bars three-dimensionally, the transfer feeder transferring a workpiece carried by the finger into each of successive work stations in a press machine wherein: the said feed drive means comprises a feed lever adapted to be swung for moving the said transfer bars in a workpiece feed direction, a cam drive means comprising a feed cam adapted to be rotated in a mechanical synchronism with an operation of the said press machine by power taken out of the said press machine, a switching means associated with the said feed cam and the said feed lever for coupling them together and decoupling them from each other, a servo drive means comprising a servo controllable feed motor for swinging the said feed lever, and a clutch means disposed between the said feed motor and the said feed lever for coupling them together and decoupling them from each other, the said switching means and the said clutch means being adapted to be actuated to render one of the said cam drive mean and the said servo drive means selectively operable to swing the said feed lever.

Each of the constructions described above provides a unique selectability for the cam drive operating mode and the servo drive operating mode of a transfer feeder in accordance with a type of products or workpieces pressed in a press machined Jointly operated. If the cam drive mode is selected, a mechanical synchronism achieved in operation of the press machine and transfer feeder permits not only the press machine but also the transfer feeder to be operated swiftly.

Also, should the servo drive means be selected, the feed pitch can be established as desired depending on a type of workpieces and so forth.

In the constructions described above, it is desirable that a second clutch means be further provided and disposed between the said press machine and the said cam drive means.

This specific feature permits the press machine to be decoupled from the transfer feeder and to be operable in an isolation.

It is also desirable that the said switching means comprise: a switching lever having on its active end a cam follower for contact with the said feed cam, and a switching drive means associated with the said switching lever and the said feed lever for swinging said switching lever to bring said cam follower into and out of contact with the said feed cam.

This specific construction provides that a slight departing of the cam follower from the feed cam by the switching drive means decouples the servo drive means and the cam drive means from each other. Should an abnormality be detected, it also permits the cam follower to instantaneously come into contact with the feed cam and thus the servo drive mode to be switched to the cam drive operating mode instantaneously which ensures preventing a movable part in the press machine and a movable part in the transfer feeder from interfering with each other and hence a further enhancement of safety for the system.

According to a third aspect of the present invention there is also provided a method of operating a transfer feeder having a pair of feed carrier groups, each group arranged parallel to the other and comprising a plurality of feed carriers coupled together in a workpiece feed direction, a cross bar extending across a pair of such feed carriers opposed each other, and a feed and a lifting drive means for moving the feed carrier groups two-dimensionally, the transfer feeder transferring workpieces carried by the cross bar into each of successive work stations in a press machine, which method comprises the steps of: providing the said feed drive means with a feed lever adapted to be swung for moving the said feed carrier groups in a workpiece feed direction, a cam drive means comprising a feed cam adapted to be rotated in a mechanical synchronism with an operation of the said press machine by power taken out of the said press machine, a switching means associated with the said feed cam and the said feed lever for coupling them together and decoupling them from each other, a servo drive means comprising a servo controllable feed motor for swinging the said feed lever, and a clutch means disposed between the said feed motor and the said feed lever for coupling them together and decoupling them from each other; and acting on the said switching means and said clutch means to render one of the said cam drive mean and the said servo drive means selectively operable to swing the said feed lever.

According to a fourth aspect of the present invention there is provided a method of operating a transfer feeder having a pair of transfer bars arranged parallel to each other in a workpiece transfer direction, a finger arranged on each of said transfer bars, and a feed, a lifting and a clamping drive means for moving said transfer bars three-dimensionally, the transfer feeder transferring a workpiece carried by the finger into each of successive work stations in a press machine, which method comprises the steps of: providing said feed drive means with a feed lever adapted to be swung for moving the said transfer bars in a workpiece feed direction, a cam drive means comprising a feed cam adapted to be rotated in a mechanical synchronism with an operation of the said press machine by power taken out of the said press machine, a switching means associated with the said feed cam and the said feed lever for coupling them together and decoupling them from each other, a servo drive means comprising a servo controllable feed motor for swinging the said feed lever, and a clutch means disposed between the said feed motor and the said feed lever for coupling them together and decoupling them from each other; and acting on the said switching means and the said clutch means to render one of the said cam drive mean and the said servo drive means selectively operable to swing the said feed lever.

These aspects of the present invention provides a unique selectability for the cam drive operating mode and the servo drive operating mode of a transfer feeder in accordance with a type of products or workpieces pressed in a press machined jointly operated. If the cam drive mode is selected, a mechanical synchronism achieved in operation of the press machine and transfer feeder permits not only the press machine but also the transfer feeder to be operated swiftly.

Also, should the servo drive means be selected, the feed pitch can readily be established as desired depending on a type of workpieces and so forth.

According to another specific feature of the methods of operating a transfer feeder described, the said cam drive means and the said servo drive means are selectively operated for pressing workpieces, to yield a large amount of products of a given kind, and to yield a variety of products in small amounts, respectively, with the said press machine.

If the cam drive means is selected, this specific feature of the present invention permits a transfer feeder to be run swiftly in a mechanical synchronism with a press machined, thus permitting a large quantity of products of a given type to be manufactured.

If the servo drive means is selected, this specific feature of the present invention permits the feed rate, the feed motion pattern and so forth to be established as desired depending on a kind of workpieces and so forth, thus readily meeting with a production requirement for a variety of products in small quantities.

According to another specific feature of the methods of operating a transfer feeder described, the said servo drive means is selectively operated in a normal condition, and the said cam drive means is selectively operated in response to an abnormality that is detected in a control means.

This specific feature of the present invention provides that detecting an abnormality in a control means or control signal path that is acting to control the servo drive means, which tends to make the press machine and the transfer feeder out of a required synchronism, permits the servo drive operating mode to be switched to the cam drive operating mode so as to move the feed lever with the cam drive means while establishing a mechanical synchronism between the press machine and the feed lever. This feature therefore permits a movable part in the transfer feeder or a work holder means or workpieces, without interfering with a movable part in the press machine or a die, to be retracted safely to a standby position.

The disadvantageous possibility that a movable part in the transfer feeder or a work piece interfering with a movable part in the press machine or a die may be thereby damaged can, therefore, be avoided.

According to another specific feature of the methods of the present invention, the said servo drive means is selectively operated with the said transfer feeder operated in an isolation, and the said cam drive means is selectively operated with the said transfer feeder operated in synchronism with the press machine.

This specific feature of the invention provides that with the transfer operated in an isolation with the servo drive means and the lifting drive means a try-out run can effectively carried out for adjusting any movable part and in a production run the transfering of workpieces can be performed with the press machine and the transfer feeder operated in mechanical synchronism.

According to a further specific feature of the methods of the present invention, either said servo drive means and said cam drive means are selectively operated in accordance with a type of dies used in the press machine.

This specific feature of the present invention permits the freedom of use of a die to be increased, and also simplifies designing dies required.

According to a further specific feature of the methods of the present invention, the lifting drive means comprises a servo motor, the said cam drive means is selectively operated to move the said feed carrier groups or transfer bars in their advance and return direction, and the said lifting drive means is selectively operated to the said feed carrier groups or transfer bars in their lifting direction.

The feed carrier groups or transfer bars can be moved in their advance and return direction in mechanical synchronism with the press machine and a movement of the feed carrier groups or transfer bars in a lifting direction is thereby isolated from a movement thereof in another direction, this permitting a lifting stroke therefor to be readily set up as desired.

BRIEF DESCRIPTION OF THE DRAWINGS

The present invention will better be understood from the following detailed description and the drawings attached hereto showing certain illustrative embodiments of the present invention. In this connection, it should be noted that such embodiments as illustrated in the accompanying drawings hereof are intended in no way to limit the present invention but to facilitate an explanation and understanding thereof.

In the accompanying drawings.

BEST MODES FOR CARRYING OUT THE INVENTION

Hereinafter, suitable embodiments of the present invention with respect to a transfer feeder and a method of operating a transfer feeder are set out with reference to the accompanying drawings hereof.

Figure 1:
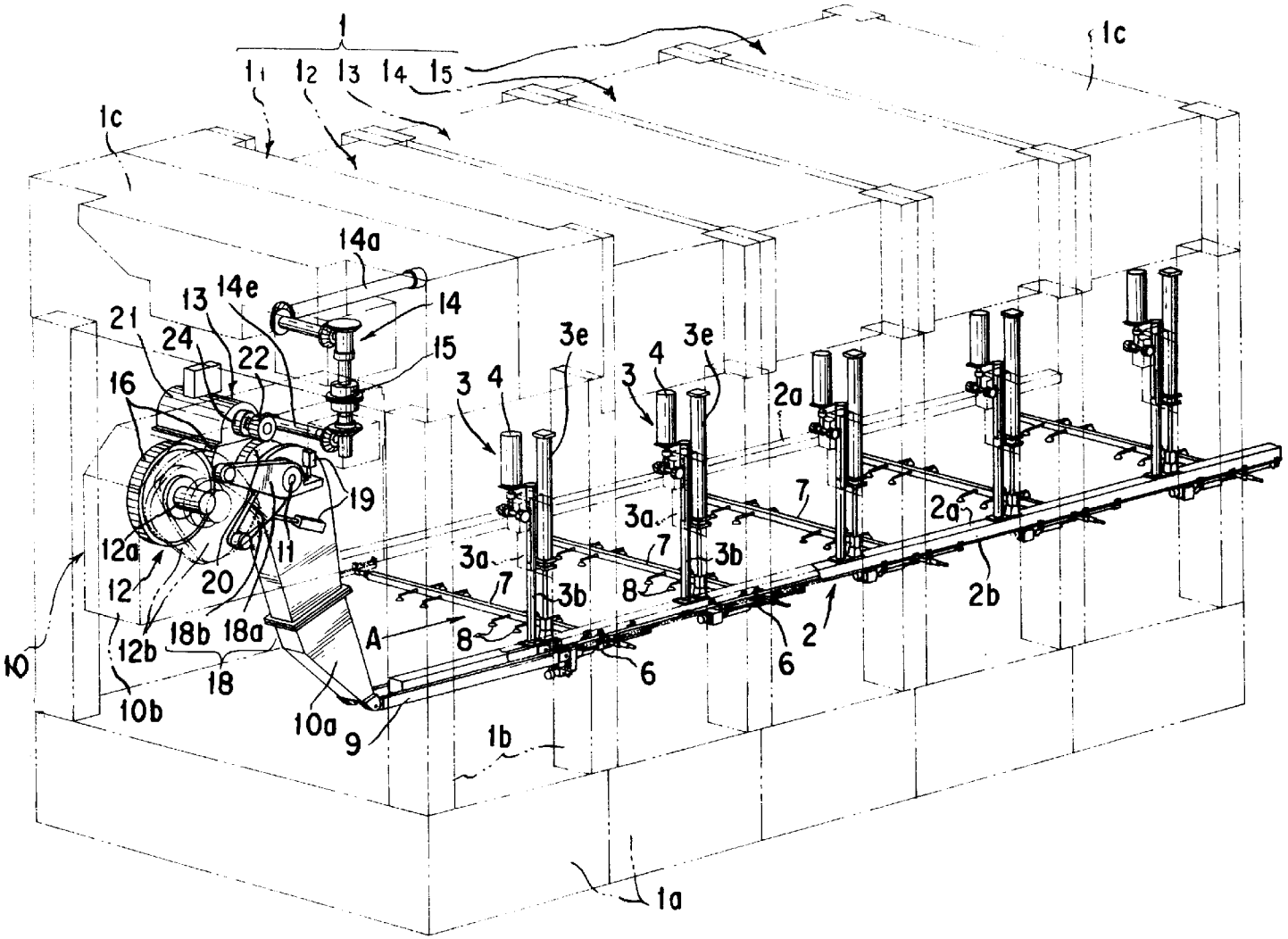
FIG. 1 is a perspective view illustrating the entire construction of a transfer feeder embodied in a first form in accordance with the present invention.
Figure 2:
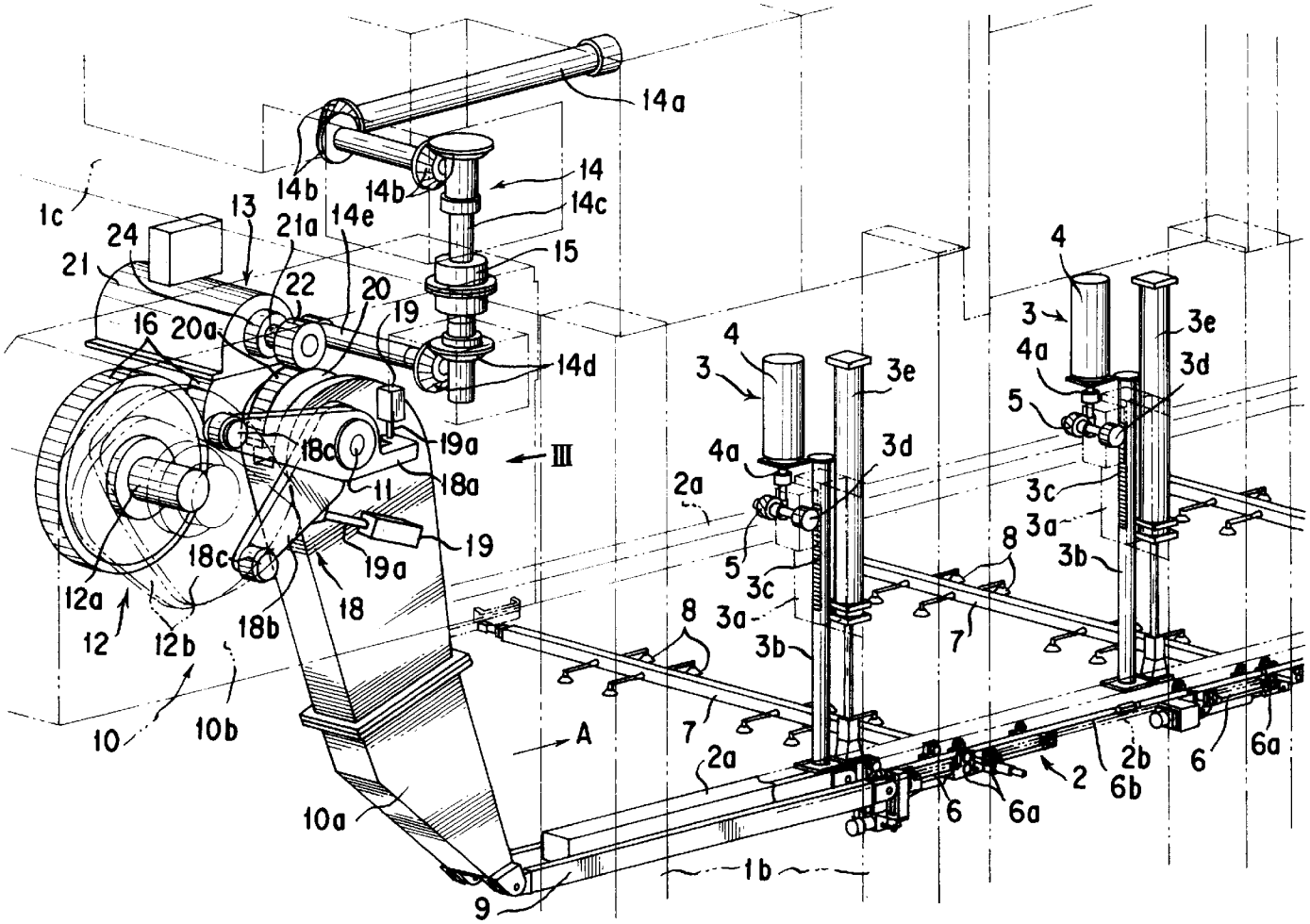
FIG. 2 is an enlarged perspective view illustrating an essential part around a feed drive means of the transfer feeder shown in FIG. 1.
Figure 3:
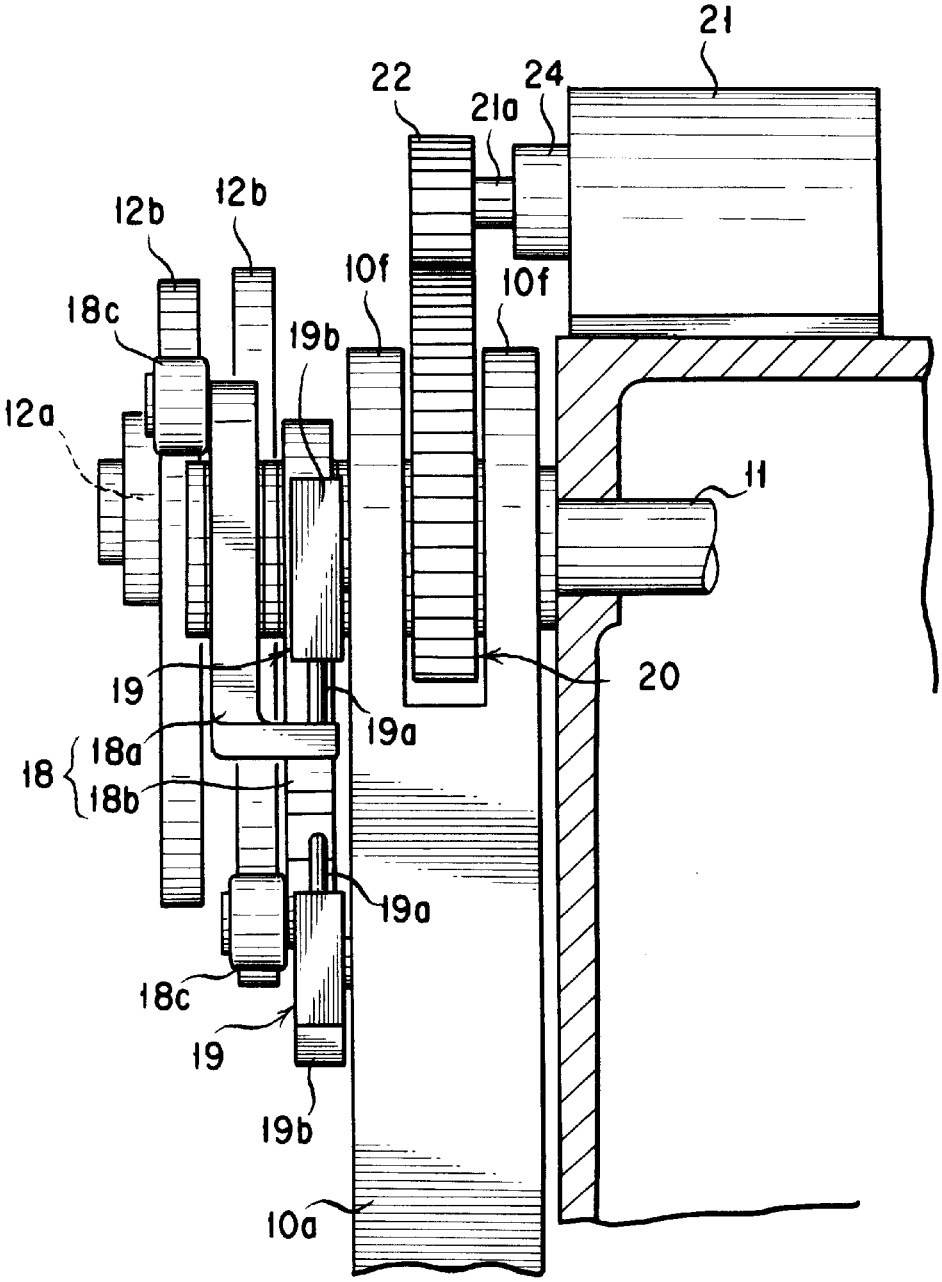
FIG. 3 is a side view illustrating a structure in part of the transfer feeder shown in FIG. 2 as viewed in the direction of the arrow III in FIG. 2.
Figure 4:
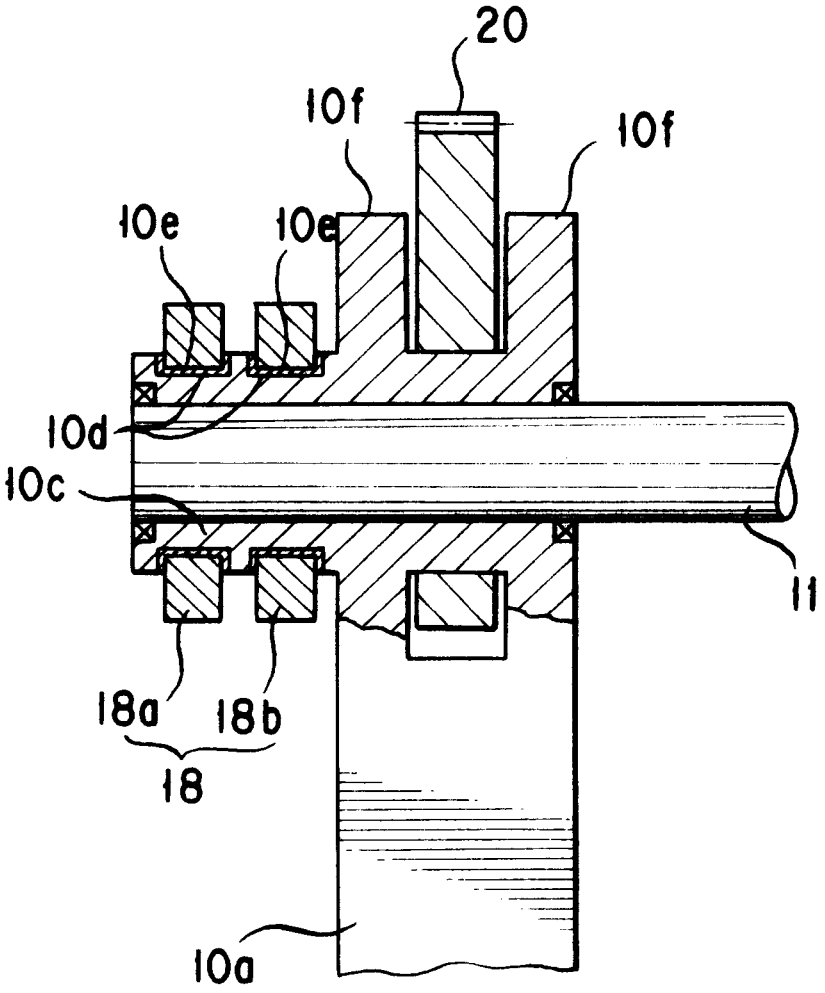
FIG. 4 is a vertical cross sectional view illustrating a portion of the structure shown in FIG. 3.

Referring to FIGS. 1 to 4 that illustrate a transfer feeder embodied in a first form in accordance with the present invention as incorporated in a module structured transfer press. FIG. 1 is a perspective view of the entire construction of such a transfer feeder; FIG. 2 is an enlarged perspective view of an essential part around a feed drive means of the transfer feeder shown in FIG. 2; FIG. 3 is a side view of a structure in part of the transfer feeder shown in FIG. 2 as viewed in the direction of the arrow III in FIG. 2; and FIG. 4 is a vertical cross sectional view illustrating a portion of the structure shown in FIG. 3.

In these Figures, a press machine 1 comprises a plurality of press units $\mathbf{1}_1$ to $\mathbf{1}_5$ that are assigned to a plurality of pressing or work stations, respectively.

Each of the press units $\mathbf{1}_1$ to $\mathbf{1}_5$ comprises a bed la, a plurality of uprights 1*b* built to stand on the bed la and a crown 1*c* that transversely rests on the uprights 1*b*. The beds 1*a* that are assigned to the successive work stations, respectively, are coupled together by fastening means (not shown) in a workpiece conveying direction A. Likewise, the crowns 1*c* that are assigned to the successive work stations, respectively, are coupled together by fastening means (not shown) in the workpiece conveying direction A.

The bed 1*a* and the crown 1*c* in each of the press units $\mathbf{1}_1$ to $\mathbf{1}_5$ are firmly connected together by a tie bolt (not shown) that passes through each of the uprights 1*b*.

A vertically movable slide (not shown) is supported on the underside of the crown 1*c* in each of the press units $\mathbf{1}_1$, to $\mathbf{1}_5$ and is arranged to be vertically driven by a slide drive means (not shown) accommodated in the crown 1*c*.

Such slides are, too, assigned to the press units $\mathbf{1}_1$ to $\mathbf{1}_5$ respectively, and each of the slides has an upper die (not shown) mounted to a lower surface thereof respectively. A lower die (not shown) is mounted on the bed 1*a* by means of a bolster, the upper and lower dies serving to work on or press a workpiece, interposed between them, in each of the press units $\mathbf{1}_1$ to $\mathbf{1}_5$.

The press machine 1 on the other hand is provided with a transfer feeder 2 that extends through the press units $\mathbf{1}_1$ to $\mathbf{1}_5$ arranged in series.

The transfer feeder 2 has a pair of lifting beams 2*a* arranged parallel to each other and extending in the workpiece conveying direction A. These lifting beams 2*a* are adapted to be together lifted up and down, while held to lie horizontally, by lift drive means 3 installed to the uprights 1*b* except the most upstream one, respectively.

Each of the lift drive means 3 has as shown in FIG. 2 in greater detail a support member 3*a* securely Joined to each of these uprights 1*b*, and by which the upper end side of a vertically movable lifting rod 3*b* is slidably supported.

The lifting rod 3*b* which is provided for each of the lift drive means 3 has its lower end fastened onto an upper surface of each of the lift beams 2*a*. An upper end region of each of the lifting rods 3*b* is formed with a rack 3*c* which is in mesh wish a pinion 3*d*.

Each of such pinions 3*d* is connected to a lifting motor 4, constituted by e.g., a servo motor, via a power transmission means 5 such as a worm reducer.

Each of such lifting motors 4 with its output shaft oriented downwards is secured to and supported by the support member 3*a*. The lifting motors 4 are energizable to rotate the pinions 3*d*, each both normally and reversely via the power transmission means 5, thereby lifting up and down the lifting rods 3*b* and in turn the lifting beams 2*a*.

As shown in FIGS. 1 and 2, a balancing cylinder 3*e*, constituted by an air cylinder, has its piston rod whose lower end is connected to each of the lifting beams 2*a* to force the lifting beams 2*a* upwards. The balancing cylinder 3*e*, thus designed to support the weight of the lifting beams 2*a*, is included to permit them to operate with lifting motors 4 reduced in size and capacity.

The lower surface of each of the lifting beams 2*a* has guide rails 2*b* protruding along its elongate sides to allow a plurality of feed carriers 6 supported thereby via rollers 6*a* to move in a longitudinal direction of the lifting beams 2*a* that is the workpiece conveying direction A.

Two such feed carriers 6 are provided for each work station as being opposed each other, across which is removably mounted a cross bar 7 extending perpendicular to the workpiece conveying direction A to bridge a space between the lifting beams 2*a*. Each of such cross bars 7 has, removably carried thereby, a plurality of work holder means 8, each constituted by, e.g., a vacuum cup, that carry a plurality of workpieces (not shown).

Adjacent ones of the feed carriers 6 on each of the lifting beams 2*a* are Joined together by a connecting rod 6*b* so that they are spaced apart from each other in the workpiece conveying direction A with a spacing that is identical to a pitch of the series connected work stations or press units $\mathbf{1}_1$ to $\mathbf{1}_5$ and the feed carriers 6 are together movable in the workpiece conveying direction A, and the feed carriers 6 located at the most upstream side each have the active end of a feed lever 10*a* in a feed drive means 10 connected thereto via a link 9.

The feed drive means 10 is located at upstreams of the press machine 1 (or downstreams thereof) and has a feed box 10*b* fastened to a side face of the crown 1*c* in the press unit $\mathbf{1}_1$ (or $\mathbf{1}_5$).

The feed box 10*b* is provided for each of the lifting beams 2*a* and accommodates in it a cam drive means 12 and a servo drive means 13.

The cam drive means 12 is designed to be a drive means for driving each of the lifting beams 2*a* mechanically with a cam mechanism, and is coupled to a slide drive means provided in the crown 1*c* via a power takeout means 14 on the side face of the crown 1*c* in the press unit $\mathbf{1}_1$ (or $\mathbf{1}_5$).

The power takeout means 14 comprises a power takeout shaft 14*a* adapted to take power out of the slide drive means, a clutch shaft 14*c* connected to the power takeout shaft 14*a* via a pair of bevel gears 14*b*, and an output shaft 14*e* connected to the clutch shaft 14*c* via a pair of bevel gears 14*d*. The clutch shaft 14*c* has on its mid portion a clutch 15 for switching on and off transmission of the power.

The output shaft 14*e* in the power takeout means 14 has connected thereto a cam shaft 12*a* in the cam drive means 12 via gear trains 16 so that the power taken out of the slide drive means in the press machine 1 may cause the cam shaft 12*a* to be rotated in synchronism with an operation of the press machine 1.

The cam shaft 12*a* is supported to extend in parallel to a support shaft 11 that supports the base end side of the feed lever 10*a*. The cam shaft 12*a* has fastened to it a pair of feed cam 12*b* each comprising a positive motion or return cam. A pair of switching levers 18*a* and 18*b* that constitute a switching lever means 18 are arranged to bring their active ends into and out of contact with the feed cams 12*b*.

As shown in FIG. 4, the feed lever 10*a* has on a side surface of its base end side a hollow cylinder 10*c* protruding on it whose outer peripheral surface is formed with a pair of annular grooves 10*d* in which the base end sides of the switching levers 18*a* and 18*b* are rotatably supported via channel bushings 10*e*, respectively, so that they may be swung.

As shown in FIGS. 2 and 3, pivotally coupled to the base portions of the switching levers 18*a* and 18*b* are the active ends of piston rods 19*a* included in two switching drive means 19 which are provided for the two switching levers 18*a* and 18*b*, respectively.

Each of the switching drive means 19 is constituted by a fluid pressure cylinder such as a hydraulic cylinder and has a cylinder portion 19*b* pivotally mounted to the above mentioned side surface of the base end side of the feed lever 10*a*. The switching lever and drive means 18 and 19 are so arranged that swinging the switching levers 18*a* and 18*b* by these switching drive means 19 may cause their active ends to be moved towards and away from each other, which may in turn cause the cam followers 18*c* supported on these active ends of the switching levers 18*a* and 18*b* to be moved to take three different positions, i.e., 1) to come in contact with the peripheral surface of the feed cam 12*b*, 2) to be slightly spaced from the peripheral surface of the feed cam 12*b* and 3) to be spaced apart from each other with a distance that is larger than the maximum diameter of the feed cam 12*b*.

As shown in FIGS. 1 to 3, the base end side of the feed lever 10*a* is connected to a servo drive means 13 via a segment gear 20.

The servo drive means 13 includes a feed motor 21 that is constituted by a servo motor mounted on the cam box lob and having an output shaft 21*a*. The feed motor output shaft 21*a* has on its midway a clutch means 24 and has at its output end a pinion 22 attached thereto which is in mesh with the segment gear 20.

The segment gear 20 is in the form of a semi-circle centering on the center of rotation of the feed lever 10*a* and is fastened to the base end side of the feed lever 10*a* as being located between the branches of a bifurcation 10*f* provided therein.

An explanation is now given of a method of operating the transfer feeder 2 constructed as so far described.

In a first mode of operation, the transfer feeder 2 is to be operated with the lifting beams 2*a* driven in the feed direction in a cam drive mode and driven in the lifting direction in a servo drive mode. In that mode of operation for the transfer feeder 2, the switching drive means 19 is operated to bring together the active ends of the switching levers 18*a* and 18*b* in the switching lever means 18. Then, the cam followers 18*a* supported on the active ends of the switching levers 18*a* and 18*b* are brought into contact with the peripheral surface of the feed cam 12*b*. Also, to prevent transmission of power between the servo drive means 13 and the feed lever 10*a*, the clutch 24 is operated to disconnect the feed lever 10*a* from the feed motor 21.

If the press machine 1 starts to operate in this state, power is taken by the power takeout means 14 out of the press machine 1 to commence operating the cam drive means 12 synchronously with the operation of the press machine 1 while the lifting drive means 3 are commenced to operate by a control means not shown synchronously with the operation of the press machine 1.

Workpieces are introduced into the press machine 1 from its upstream side and are carried by the work holder means 8 on the most upstream side cross bar 7.

Then, after the lifting beams 2*a* are raised by the lifting drive means 3 to lift the workpieces up to a work conveying height (pass line), the feed cams 12*b* are operable to act on the switching levers 18*a* and 18*b* to swing the feed levers 10*a* so as to move their active ends downstreams.

Thus, by the links 9 the feed carriers 6 supported on the lifting beams 2*a* are moved and advanced downstreams to move and advance the cross bars 7 extending across them downstreams. Then, the workpieces carried by the work holder means 8 on the most upstream cross bar 7 are moved above the first work station, while the workpieces carried by the work holder means 8 on the cross bar in one work station are moved above the next work station. Thereafter, lowering the lifting beams 2*a* with the lifting drive means 3 causes the workpieces on the work holder means 8 located above any work station to be lifted down and introduced into that work station.

Thereafter, with the work holder means 8 releasing the workpieces, the lifting beams 2*a* are lifted up with the lifting drive means 3. Then, the feed cams 12*b* are driven to swing the feed levers 10*a* so as to move their active ends upstreams, thereby displacing and returning the feed carriers 6 upstreams each to a standby position.

Then, the slides for the press units $\mathbf{1}_1$ to $\mathbf{1}_5$ are lowered each with a slide drive mechanism in the crown 1*c* to permit workpieces introduced into each work station to be pressed and thereby formed therein.

When the slides starts to ascend with the workpieces pressed and thereby formed, the feed cams 12*b* again act on the feed levers 10*a* to allow the feed carriers 6 to be moved further upstreams and to return to their original positions where the work holder means 8 for each work station are actuated to carry newly introduced workpieces and the workpieces pressed and thereby formed in the preceding work station(s).

While workpieces are transferred in this way, the operation of the feed carriers 6 in their feed direction in the transfer feeder 2, mechanically synchronized with the operation of the press machine 1 prevents any of the movable parts including a press die in the press machine 1 and any of the movable parts such as the cross bars 7 and the work holder means 8 in the transfer feeder 2 from interfering with each other if the press machine 1 is emergency halted for any reason.

A cam drive system as thus far described in which the press machine 1 and the transfer feeder 2 are mechanically synchronized to operate the transfer feeder 2 permits the transfer feeder 2 to be operated at an increased speed and is hence most suitable to manufacture a large quantity of products of a given kind.

In a second mode of operation, the transfer feeder 2 is operated with the lifting beams 2*a* driven in each of both their feed and lifting directions in a servo drive mode. In that mode of operation for the transfer feeder 2, the switching drive means 19 is operated to open the active ends of the switching levers 18*a* and 18*b* somewhat each other and to locate the cam followers 18*c* supported on these active ends, slightly spaced from the peripheral surface of the feed cam 12*b*. Also, to permit each of the feed levers 10*a* to be driven by the servo drive means 13, the feed motor 21 is connected to the feed lever 10*a* by the clutch means 24.

In this state, workpieces may be introduced into the press machine 1 from its upstream side and are carried by the work holder means 8 on the most upstream side cross bar 7.

Then, after the lifting beams 2*a* are raised by the lifting drive means 3 to lift the workpieces up to a work conveying height (pass line), the feed motor 21 in each of the servo drive means 13 is driven synchronously with the operation of the press machine 1 to rotate the pinion 22 and the segment gear 20. Thus, the feed levers 10*a* are swung to move their active ends downstreams.

Thus, by the links 9 the feed carriers 6 supported on the lifting beams 2*a* are moved and advanced downstreams to move and advance the cross bars 7 extending across them downstreams. Then, the workpieces carried by the work holder means 8 on the most upstream cross bar 7 are moved above the first work station, while the workpieces carried by the work holder means 8 on the cross bar in one work station are moved above the next work station. Thereafter, lowering the lifting beams 2*a* with the lifting drive means 3 causes the workpieces on the work holder means 8 located above any work station to be lifted down and introduced into that work station.

Thereafter, with the work holder means 8 releasing the workpieces, the lifting beams 2*a* are lifted up with the lifting drive means 3. Then, the feed motors 21 are driven to swing the feed levers 10*a* so as to move their active ends upstreams, thereby displacing and returning the feed carriers 6 upstreams each to stop at a standby position.

Then, the slides for the press units $\mathbf{1}_1$ to $\mathbf{1}_5$ are lowered each with a slide drive mechanism in the crown 1*c* to permit workpieces introduced into each work station to be pressed and thereby formed therein.

When the slides start to ascend with the workpieces pressed and thereby formed, the feed motors 21 again act on the feed levers 10*a* to allow the feed carriers 6 to be moved further upstreams and to return to their original positions where the work holder means 8 for each work station are actuated to carry newly introduced workpieces and the workpieces pressed and thereby formed in the preceding work station(s).

While workpieces are transferred in this way, the feed cams 12*b* in the cam drive means 12 are also rotated in synchronism with the operation of the press machine 1. However, the switching drive means 19 operated to open the active ends of the switching levers 18*a* and 18*b* somewhat to each other so as to locate the cam followers 18*c* slightly spaced from the peripheral surface of the feed cam 12*b*, prevents a rotation of the feed cam 12*b* from being applied to the feed lever 10*a* and thus prevents the feed levers 10*a* from being driven mechanically.

While the preceding description has been focused to conveying and transferring workpieces alone from one work station to another by driving the lifting beams 2*a* both in the feed and lifting directions with the servo drive means 13 and the lifting drive means 3, in some instances in which the kind of workpieces to be formed in the press machine 1 must be altered requiring dies to be exchanged the need also arises that a cross bar 7, together with used dies and work holder means 8, be conveyed out of the press machine 1 to exchange them with dies and work holder means 8 adapted to meet the kind of workpieces to be next formed, requiring the feed and/or lifting strokes to be altered as well.

Selecting a servo drive mode and system in such an instance permits a control means simply with a preliminary input for a feed and/or a lifting stroke entered as required to meet with workpieces then to be formed, to act on the servo drive means 13 and/or the lifting drive means 3 so as to establish the feed and/or lifting strokes required. The servo drive mode and system that thus is free from the need to exchange components such as cams in the cam drive system and mode in the transfer feeder 2 and to entail the setup operations associated, is preferred for the manufacture of products small in amounts and wide in varieties where dies need to be frequently altered.

If, however, the servo feed mode and system is employed for moving the lifting beams 2*a* both in the feed and lifting directions, then while it permits the feed and lifting pitches to be readily altered, there is a possibility that the press machine 1 and the transfer feeder 2 becomes asynchronous in operation and hence that a movable part in the press machine 1 and a movable part in the transfer feeder 2 may interfere with each other.

In case an abnormality or trouble should happen in a control signal path while the lifting beams 2*a* are being moved in both the feed and lifting directions in the servo drive mode, the illustrated embodiment of the present invention incorporates an arrangement whereby the servo drive mode is instantaneously switched to the cam drive mode for the lifting beams 2*a* moving in the feed direction so there may be no interference of movable parts.

Specifically, while the lifting beams 2*a* are being servoed in the feed direction, it has been shown that the active ends of the switching levers 18*a* and 18*b* are opened to each other locating the cam followers 18*c* spaced slightly from the peripheral surface of the feed cam 12*b* in each of the cam drive means 12. Then in this state, if an abnormality or trouble is detected by, e.g., a control means as earlier described, an abnormality signal developed is used to extend the piston rod 19*a* from the fluid pressure cylinder 19*b* in the switching drive means 19, which causes the cam followers 18*c* instantaneously to come into contact with the feed cam 12*b* in each of the cam drive means 12. The clutch means 24 is released to disconnect the feed lever 10*a* from the feed motor 21, interrupting power transmission.

Thereafter, the feed cams 12*b* act to drive and move the feed carriers 6 synchronously with the operation of the press machine 1, preventing a movable part in the press machine 1 from interfering with a movable part in the transfer feeder 2 if an abnormality or trouble should take place in a control means or signal transmission path.

In addition to operating the press machine 1 and the transfer feeder 2 jointly as described above, that is, operating the transfer feeder 2 in association with the press machine 1 for forming workpieces, they upon a separation may each be operated singly as required where dies are to be exchanged in the press machine 1 or where cross bars 7 are to be exchanged in the transfer feeder 2.

Specifically, if the press machine 1 is to be operated singly, the clutch means 5 on the power takeout means 14 should be released to disconnect the slide drive means in the press machine 1 from the feed drive means 12 in the transfer feeder 2.

Since the cam shafts 12*a* in the feed drive means 12 may then be by no means rotated, the press machine 1 being operated no longer causes the transfer feeder 2 to be operated, permitting the press machine 1 alone to be operated.

The transfer feeder 2 may be adapted to operate singly, where the clutch means 15 is released, further by acting on the switching drive means 19 so as to open to each other the active ends of the switching levers 18*a* and 18*b* to an extent that the cam followers 18*c* on these active ends are spaced apart from each other with a distance that is larger than the maximum diameter of the feed cam 12*b* in each of the feed drive means 12.

Then, the clutch means 24 is acted on to establish a connection of the feed motor 21 to the pinion 22 and the segment gear 20 such as to permit the feed lever 10*a* to be swung in the feed direction. The transfer feeder 2 can thus be alone operated in the servo drive mode with the lifting drive means 3 raising and lowering the lifting beams 2*a*.

It should be noted that a single or isolated operation with the transfer feeder 2 is effective in what is called a try-out run designed to check if a cross bar 7 or a work holder means 8 exchanged may not interfere with the slide or a die in the press machine 1.

Referring now to FIGS. 5 to 8, an explanation will be given of a second form of embodiment of the present invention as applied to a module structured transfer press as previously described.

Figure 5:
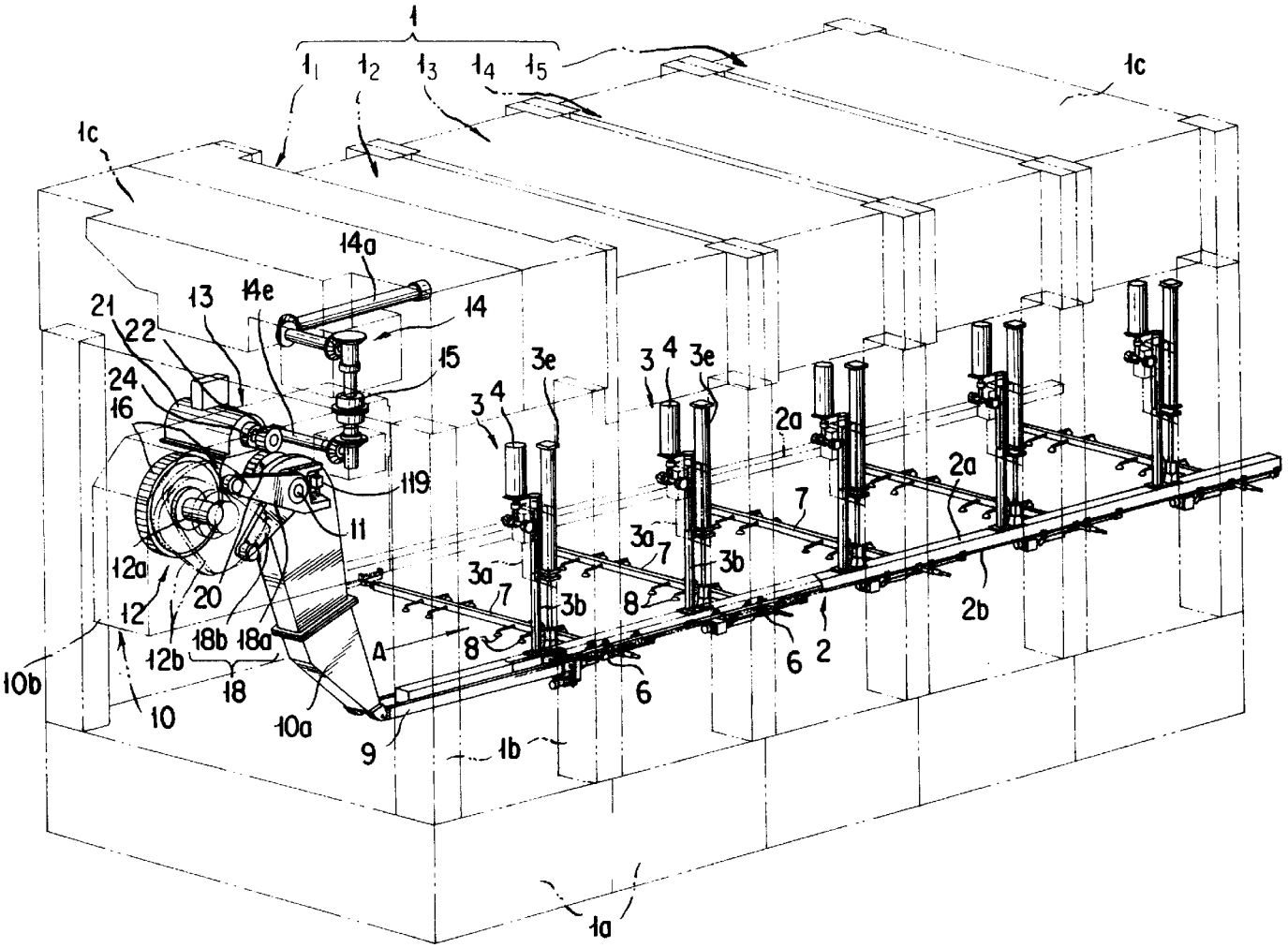
FIG. 5 is a perspective view illustrating the entire construction of a transfer feeder embodied in a second form in accordance with the present invention.
Figure 6:
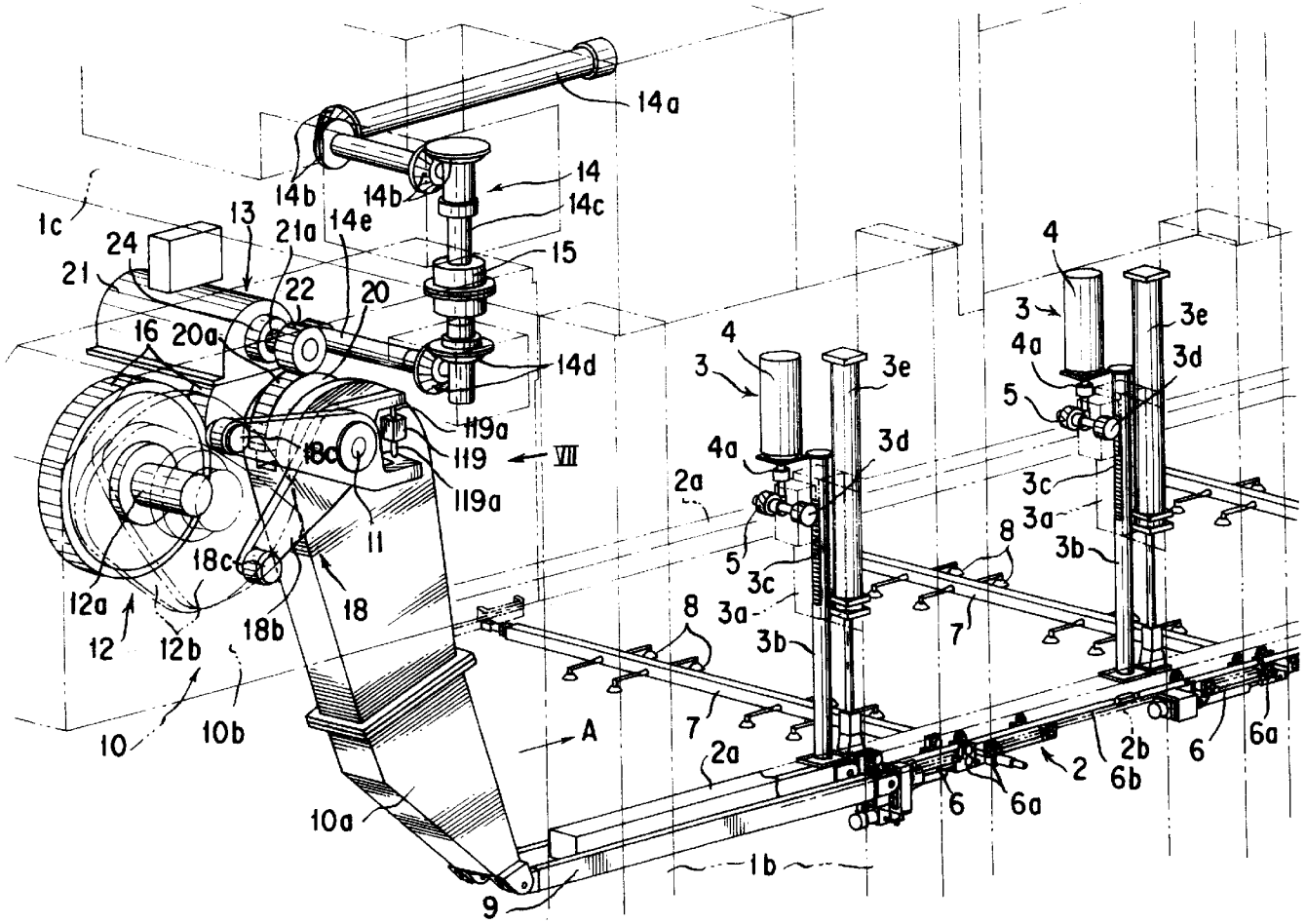
FIG. 6 is an enlarged perspective view illustrating an essential part around a feed drive means of the transfer feeder shown in FIG. 5.
Figure 7:
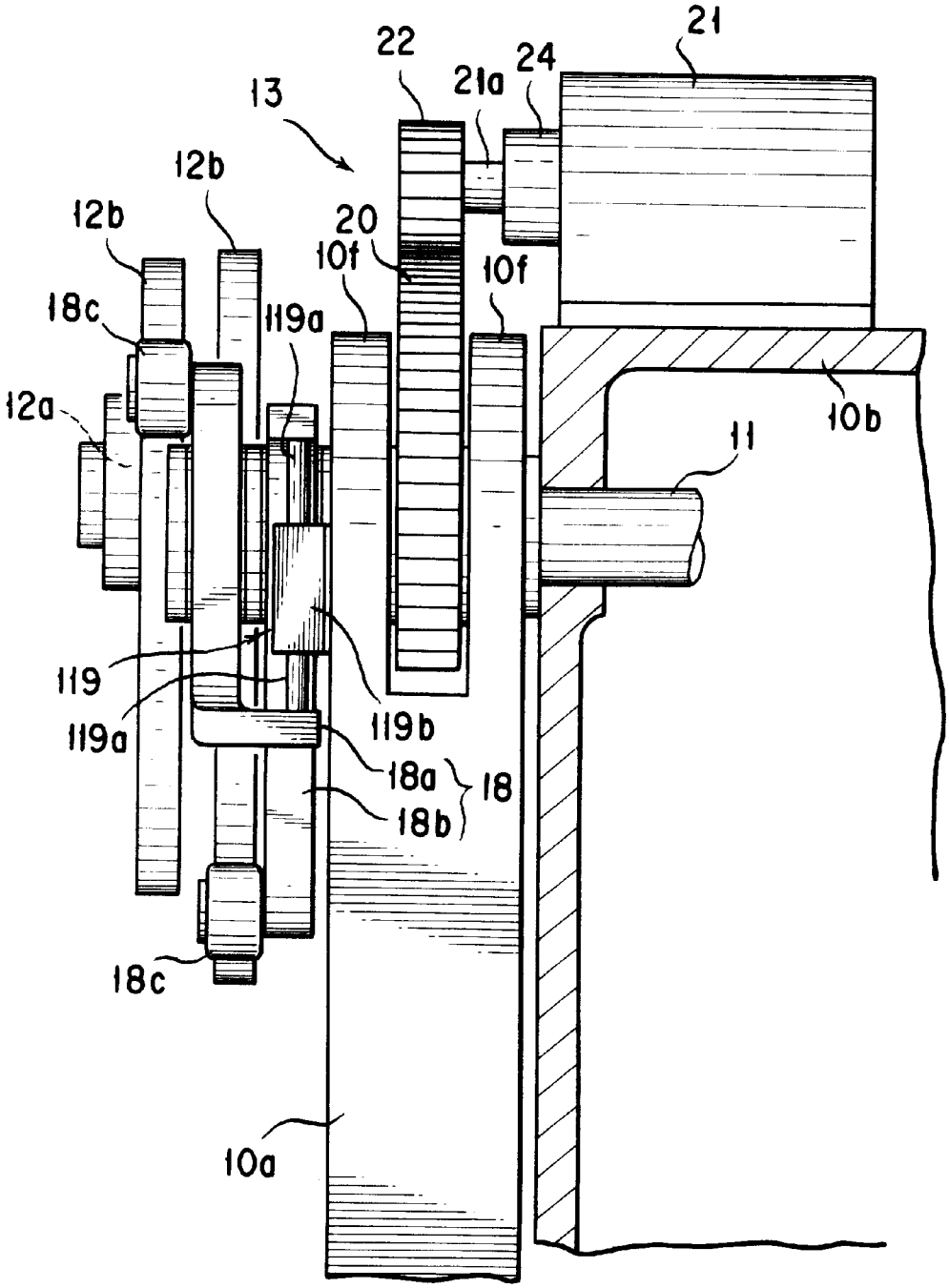
FIG. 7 is a side view illustrating a structure in part of the transfer feeder shown in FIG. 6 as viewed in the direction of the arrow VII in FIG. 6.
Figure 8:
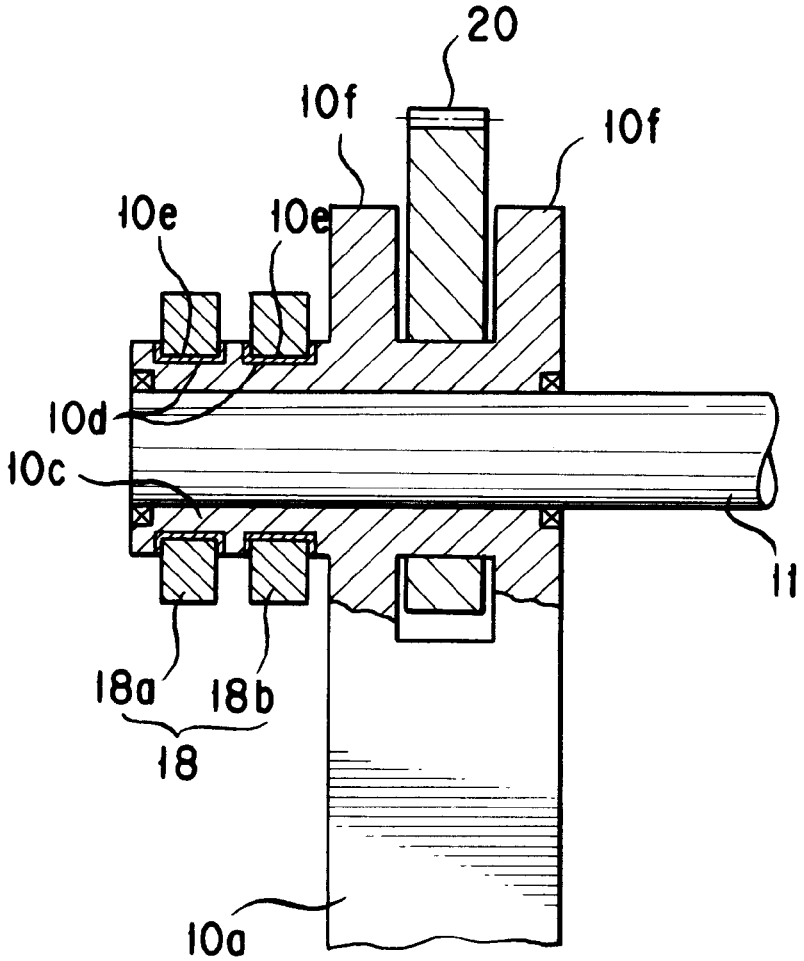
FIG. 8 is a vertical cross sectional view illustrating a portion of the structure shown in FIG. 7.

FIG. 5 is a perspective view of the entire construction of such a transfer feeder; FIG. 6 is an enlarged perspective view of an essential part around a feed drive means of the transfer feeder shown in FIG. 5; FIG. 7 is a side view of a structure in part of the transfer feeder shown in FIG. 6 as viewed in the direction of the arrow VII in FIG. 6; and FIG. 8 is a vertical cross sectional view illustrating a portion of the structure shown in FIG. 7.

In these Figures, the same reference characters as used in FIGS. 1 to 4 are used to designate the same components or parts in the first form of embodiment whose repeated description in detail is here omitted.

In this transfer feeder 2, a single switching drive means 119 that comprises a double acting cylinder is provided to constitute a switching drive means as previously described to act on the switching levers 18*a* and 18*b*.

The switching drive means 119 specifically has as shown in FIG. 7 a cylinder portion 119*b* fastened to a base end side surface of the feed lever 10*a*, and a pair of piston rods 119*a* projecting from the cylinder portion 119*b* upwards and downwards. The upper and lower ends of these piston rods 119*a* projecting upwards and downwards are connected to the base ends of the switching levers 18*a* and 18*b*, respectively. Thus, the piston rods 119*a* when extended and retracted act to close and open to each other the active ends of the switching levers 18*a* and 18*b* to move the cam followers 18*c* towards and away from, or to bring them into and out of contact with, the profiled periphery of the feed cam 12*b*, respectively.

The transfer feeder 2 in this embodiment operates as described below.

Normally or to move the lifting beams 2*a* in the servo drive mode, the switching drive means 119 holds the active ends of the switching levers 18*a* and 18*b* opening to each other. The cam followers 18*c* on the active ends of the switching levers 18*a* and 18 are then spaced slightly from the peripheral surface of the feed cam 12*b*.

In this state, workpieces may be introduced into the press machine 1 from its upstream side and are carried by the work holder means 8 on the most upstream side cross bar 7.

Then, after the lifting beams 2*a* are raised by the lifting drive means 3 to lift the workpieces up to a work conveying height (pass line), the feed motor 21 in each of the servo drive means 13 is driven synchronously with the operation of the press machine 1 to rotate the pinion 22 and the segment gear 20 to cause the feed lever 10*a* to be swung to move its active end downstreams.

Thus, via the links 9 the feed carriers 6 supported on the lifting beams 2*a* are moved and advanced downstreams to move and advance the cross bars 7 extending across them downstreams. Then, the workpieces carried by the work holder means 8 on the most upstream cross bar 7 are moved above the first work station, while the workpieces carried by the work holder means 8 on the cross bar in one work station are moved above the next work station. Thereafter, lowering the lifting beams 2*a* with the lifting drive means 3 causes the workpieces on the work holder means 8 located above any work station to be lifted down and introduced into that work station.

Thereafter, with the work holder means 8 releasing the workpieces, the lifting beams 2*a* are lifted up with the lifting drive means 3. Then, the feed motors 21 are driven to swing the feed levers 10*a* so as to move their active ends upstreams, thereby displacing and returning the feed carriers 6 upstreams each to stop at a standby position.

Then, the slides for the press units $\mathbf{1}_1$ to $\mathbf{1}_5$ are lowered each with a slide drive mechanism in the crown 1*c* to permit workpieces introduced into each work station to be pressed and thereby formed therein.

When the slides starts to ascend with the workpieces pressed and thereby formed, the feed motors 21 again act on the feed levers 10*a* to allow the feed carriers 6 to be moved further upstreams and to return to their original positions where the work holder means 8 for each work station are actuated to carry newly introduced workpieces and the workpieces pressed and thereby formed in the preceding work station(s).

While workpieces are transferred in this way, the feed cams 12*b* in the cam drive means 12 are also rotated in synchronism with the operation of the press machine 1. However, the switching drive means 119 operated to open the active ends of the switching levers 18*a* and 18*b* somewhat to each other so as to locate the cam followers 18*c* slightly spaced from the peripheral surface of the feed cam 12*b*, prevents a rotation of the feed cam 12*b* from being applied to the feed lever 10*a* and thus prevents the feed levers 10*a* from being driven mechanically.

During an operation of the transfer feeder 2, if an abnormality or trouble should happen in a control means (not shown) that is acting to control the servo drive means 13 to operate in synchronism with the operation of the press machine 1, an abnormality sensing means (not shown) detects the abnormality and causes the switching drive means 119 to instantaneously close to each other the active ends of the switching levers 18*a* and 18*b* to bring the cam followers 18*c* into contact with the profiled periphery of the feed cam 12*b* while at the same time releasing the clutch means 24 to disconnect the feed motor 21 from the feed levers 10*a*.

This causes the feed carriers 6 that have been driven electrically by the feed motors 21 to be driven mechanically by the feed cams 12*b* via the feed levers 10*a*. Further because the operation of the press machine 1 and the operation of the transfer feeder 2 remain in synchronism, the occurrence of an abnormality while the feed carriers 6 are in movement rendering the servo drive means 13 inoperable to control does not cause a movable part in the press machine 1 and a movable part in the transfer feeder 2 to interfere with each other, thus permitting the transfer feeder to halt its operation at a safety position.

Thus, driving the feed carriers 6 normally with the servo drive means 13 permits a required change in their feed stroke and so forth to be met simply with a change in the program alone and without requiring the feed cams and others to be exchanged. If an abnormality or trouble should happen in a control means or control signal path, the operations of the press machine 1 and the feed carriers 6 synchronized by the cam drive means 12 ensures preventing an interference of a movable part in the press machine 1 and a movable part in the transfer feeder 2.

In concluding the description, it should be noted that while in each of the embodiments of the invention set fourth thus far, the transfer feeder 2 had a two-dimensional motion configuration in which the lifting bars 2*a* are driven vertically and the feed carriers 6 are displaced in the feed direction, the transfer feeder of the present invention is readily modified to have a three-dimensional movement configuration by providing transfer bars (not shown) that are movable to operate in the feed, lifting and clamping directions to convey and transfer workpieces three-dimensionally.

In such a modification, the transfer bars have at their opposite positions the work holder means like as fingers to which the workpieces are clamped to be conveyed and transferred into, through and out of each of the working stations.

Further, while in the embodiments so far described a positive motion (return) cam is used for each of the feed cams 12*b* in the cam drive means 12, it may be replaced with a common cam.

Should a replacement be effected, a reaction cylinder assembly may be provided as arranged to urge the switching levers 18*a* and 18*b* so that the cam followers 18*c* may always be held in contact with the cam surface, i.e., so that the cam followers 18*c* may not depart from the cam surface when the feed carriers 6 are operated by the feed cams 12*b*.

Further, while the transfer feeder 2 has been set forth and illustrated as applied to a module structured transfer press in which the press machine 1 comprises a series of press units allocated to successive work stations, it suffices to say that the present invention is applicable to an ordinary transfer press in which the press machine 1 is unitary.

While the present invention has hereinbefore been set forth with respect to certain illustrative embodiments thereof, it will readily be appreciated by a person skilled in the art to be obvious that many alterations thereof, thereof, it will readily be appreciated by a person skilled omissions therefrom and additions thereto can be made without departing from the essence and the scope of the present invention. Accordingly, it should be understood that the invention is not intended to be limited to the specific embodiments thereof set out above, but to include all possible embodiments thereof that can be made within the scope with respect to the features specifically set forth in the appended claims and encompasses all the equivalents thereof.

What is claimed is:

1. A transfer feeder having a pair of feed carrier groups, each group arranged parallel to the other and comprising a plurality of feed carriers coupled together in a workpiece feed direction, a cross bar extending across a pair of such feed carriers opposed to each other, and a feed and a lifting drive means for moving the feed carrier groups two-dimensionally, the transfer feeder transferring workpieces carried by the cross bar into each of successive work stations in a press machine wherein:

said feed drive means comprises a feed lever adapted to be swung for moving said feed carrier groups in a workpiece feed direction, a cam drive means comprising a feed cam adapted to be rotated in mechanical synchronism with an operation of said press machine by power taken out of said press machine, a switching means associated with said feed cam and said feed lever for coupling them together and decoupling them from each other, a servo drive means comprising a servo controllable feed motor for swinging said feed lever, and a clutch means disposed between said feed motor and said feed lever for coupling them together and decoupling them from each other, said switching means and said clutch means being adapted to be actuated to render one of said cam drive means and said servo drive means selectively operable to swing said feed lever.

2. A transfer feeder having a pair of transfer bars arranged parallel to each other in a workpiece transfer direction, a finger arranged on each of said transfer bars, and a feed, a lifting and a clamping drive means for moving said transfer bars three-dimensionally, the transfer feeder transferring a workpiece carried by the finger into each of successive work stations in a press machine wherein:

said feed drive means comprises a feed lever adapted to be swung for moving said transfer bars in a workpiece feed direction, a cam drive means comprising a feed cam adapted to be rotated in mechanical synchronism with an operation of said press machine by power taken out of said press machine, a switching means associated with said feed cam and said feed lever for coupling them together and decoupling them from each other, a servo drive means comprising a servo controllable feed motor for swinging said feed lever, and a clutch means disposed between said feed motor and said feed lever for coupling them together and decoupling them from each other, said switching means and said clutch means being adapted to be actuated to render one of said cam drive means and said servo drive means selectively operable to swing said feed lever.

3. A transfer feeder as set forth in claim 1 or claim 2, further comprising a second clutch means disposed between said press machine and said cam drive means.

4. A transfer feeder as set forth in claim 1 or claim 2, wherein said switching means comprises:

a switching lever having on its active end a cam follower for contact with said feed cam, and a switching drive means associated with said switching lever and said feed lever for swinging said switching lever to bring said cam follower into and out of contact with said feed cam.

5. A method of operating a transfer feeder having a pair of feed carrier groups, each group arranged parallel to the other and comprising a plurality of feed carriers coupled together in a workpiece feed direction, a cross bar extending across a pair of such feed carriers opposed to each other, and a feed and a lifting drive means for moving the feed carrier groups two-dimensionally, the transfer feeder transferring workpieces carried by the cross bar into each of successive work stations in a press machine, the method comprising the steps of:

providing said feed drive means with:

a feed lever adapted to be swung for moving said feed carrier groups in a workpiece feed direction, a cam drive means comprising a feed cam adapted to be rotated in mechanical synchronism with an operation of said press machine by power taken out of said press machine, a switching means associated with said feed cam and said feed lever for coupling them together and decoupling them from each other, a servo drive means comprising a servo controllable feed motor for swinging said feed lever, and a clutch means disposed between said feed motor and said feed lever for coupling them together and decoupling them from each other; and acting on said switching means and said clutch means to render said one of cam drive means, and said servo drive means selectively operable to swing said feed lever.

6. A method of operating a transfer feeder having a pair of transfer bars arranged parallel to each other in a workpiece transfer direction, a finger arranged on each of said transfer bars, and a feed, a lifting and a clamping drive means for moving said transfer bars three-dimensionally, the transfer feeder transferring a workpiece carried by the finger into each of successive work stations in a press machine, the method comprising the steps of:

providing said feed drive means with:

a feed lever adapted to be swung for moving said transfer bars in a workpiece feed direction, a cam drive means comprising a feed cam adapted to be rotated in mechanical synchronism with an operation of said press machine by power taken out of said press machine, a switching means associated with said feed cam and said feed lever for coupling them together and decoupling them from each other, a servo drive means comprising a servo controllable feed motor for swinging said feed lever, and a clutch means disposed between said feed motor and said feed lever for coupling them together and decoupling them from each other; and acting on said switching means and said clutch means to render one of said cam drive means and said servo drive means selectively operable to swing said feed lever.

7. A method as set forth in claim 5 or claim 6, wherein said cam drive means and said servo drive means are selectively operated for pressing workpieces, to yield a large amount of products of a given kind, and to yield a variety of products in small amounts, respectively, with said press machine.

8. A method as set forth in claim 5 or claim 6, wherein said servo drive means is selectively operated in a normal condition, and said cam drive means is selectively operated in response to an abnormality that is detected in a control means.

9. A method as set forth in claim 5 or claim 6 wherein said servo drive means is selectively operated with said transfer feeder operated in isolation, and said cam drive means is selectively operated with said transfer feeder operated synchronously with the press machine.

10. A method as set forth in claim 5 or claim 6 wherein either said servo drive means and said cam drive means are selectively operated in accordance with a type of dies used in the press machine.

11. A method as set forth in claim 5 wherein said lifting drive means comprises a servo motor, the method further comprising:

selectively operating said cam drive means to move said feed carrier groups in their advance and return direction; and selectively operating said lifting drive means to move said feed carrier groups in their lifting direction.

12. A method as set forth in claim 6 wherein said lifting drive means comprises a servo motor, the method further comprising:

selectively operating said cam drive means to move said transfer bars in their advance and return direction, and selectively operating said lifting drive means to move said transfer bars in their lifting direction.

13. A transfer feeder as set forth in claim 3, wherein said switching means comprises:

a switching lever having on its active end a cam follower for contact with said feed cam, and a switching drive means associated with said switching lever and said feed lever for swinging said switching lever to bring said cam follower into and out of contact with said feed cam.

* * * * *